US008827707B2

(12) United States Patent
Varshneya

(10) Patent No.: US 8,827,707 B2
(45) Date of Patent: Sep. 9, 2014

(54) TWO BEAM SMALL ARMS TRANSMITTER

(75) Inventor: Deepak Varshneya, Del Mar, CA (US)

(73) Assignee: Cubic Corporation, San Diego, CA (US)

( * ) Notice: Subject to any disclaimer, the term of this patent is extended or adjusted under 35 U.S.C. 154(b) by 965 days.

(21) Appl. No.: 11/194,992

(22) Filed: Aug. 1, 2005

(65) Prior Publication Data

US 2008/0003543 A1 Jan. 3, 2008

(51) Int. Cl.

| | |
|---|---|
| ***F41G 3/26*** | (2006.01) |
| ***F41A 33/02*** | (2006.01) |
| ***F41G 3/32*** | (2006.01) |
| ***F41G 1/54*** | (2006.01) |

(52) U.S. Cl.

CPC ..... *F41G 3/2655* (2013.01); *F41A 33/02* (2013.01); *F41G 3/326* (2013.01); *F41G 1/54* (2013.01)

USPC ..... 434/21; 434/11; 434/16; 434/19; 434/22

(58) Field of Classification Search

CPC ..... F41A 33/02; F41G 3/326

USPC ..... 434/11, 16, 19, 21, 22; 42/114, 115, 42/117

See application file for complete search history.

(56) References Cited

U.S. PATENT DOCUMENTS

| | | | | | |
|---|---|---|---|---|---|
| 3,452,453 | A * | 7/1969 | Ohlund | 434/22 |
| 4,136,956 | A * | 1/1979 | Eichweber | 356/153 |
| 4,339,177 | A * | 7/1982 | March | 359/707 |
| 4,464,974 | A * | 8/1984 | Goda | 89/41.06 |
| 4,470,817 | A * | 9/1984 | Diehl et al. | 434/22 |
| 4,619,616 | A * | 10/1986 | Clarke | 434/22 |
| 4,640,514 | A * | 2/1987 | Myllyla et al. | 463/51 |
| 4,689,016 | A * | 8/1987 | Eichweber | 434/22 |
| 4,877,324 | A * | 10/1989 | Hauri et al. | 356/251 |
| 4,955,812 | A * | 9/1990 | Hill | 434/16 |
| 4,975,565 | A * | 12/1990 | Schmidt et al. | 250/203.2 |
| 5,001,836 | A * | 3/1991 | Cameron et al. | 42/116 |
| 5,060,391 | A * | 10/1991 | Cameron et al. | 42/115 |
| 5,344,320 | A * | 9/1994 | Inbar et al. | 434/22 |
| 5,410,815 | A * | 5/1995 | Parikh et al. | 42/115 |
| 5,475,385 | A | 12/1995 | Pettit et al. | |
| 5,476,385 | A * | 12/1995 | Parikh et al. | 434/22 |
| 5,788,500 | A * | 8/1998 | Gerber | 434/22 |
| 6,174,169 | B1 * | 1/2001 | Gerber | 434/11 |
| 6,322,365 | B1 * | 11/2001 | Shechter et al. | 434/21 |
| 6,406,298 | B1 * | 6/2002 | Varshneya et al. | 434/21 |
| 6,439,892 | B1 * | 8/2002 | Gerber | 434/11 |
| 6,450,816 | B1 * | 9/2002 | Gerber | 434/11 |

(Continued)

*Primary Examiner* — Sam Yao
*Assistant Examiner* — Alvin Carlos
(74) *Attorney, Agent, or Firm* — Kilpatrick Townsend & Stockton LLP

(57) ABSTRACT

A Small Arms Transmitter (SAT) having two optical sources for use in a military training environment is described. The SAT includes an infrared laser as a first optical source. A visible optical source, such as a visible wavelength laser, is configured as a second optical source. The visible wavelength laser can be configured to be selectively energized during a beam alignment operation. A combiner can be configured to combine the beam from the infrared laser with the beam from the visible wavelength laser to produce a combined beam. The optical axis of the combined infrared and visible wavelength lasers can be adjusted using an optical steering module. A first optical steering module can be configured to steer the combined beam substantially along a first axis, while a second optical steering module can be configured to steer the combined beam along a second axis substantially orthogonal to the first axis.

23 Claims, 6 Drawing Sheets

(56) References Cited

U.S. PATENT DOCUMENTS

| | | | | |
|---|---|---|---|---|
| 6,473,980 | B2 * | 11/2002 | Ripingill et al. | 33/506 |
| 6,549,872 | B2 * | 4/2003 | Bollweg et al. | 702/158 |
| 6,572,375 | B2 * | 6/2003 | Shechter et al. | 434/19 |
| 6,579,098 | B2 * | 6/2003 | Shechter | 434/21 |
| 6,793,494 | B2 * | 9/2004 | Varshneya et al. | 434/21 |
| 6,887,079 | B1 * | 5/2005 | Robertsson et al. | 434/22 |
| 6,914,731 | B2 * | 7/2005 | Fredriksson | 359/754 |
| 7,192,282 | B2 * | 3/2007 | Cederwall | 434/18 |
| 7,293,992 | B2 * | 11/2007 | Fredriksson | 434/21 |
| 7,367,805 | B2 * | 5/2008 | Renntoft | 434/22 |
| 2002/0012898 | A1 * | 1/2002 | Shechter et al. | 434/21 |
| 2002/0064761 | A1 * | 5/2002 | Ripingill et al. | 434/19 |
| 2002/0134000 | A1 * | 9/2002 | Varshneya et al. | 42/115 |
| 2003/0175661 | A1 * | 9/2003 | Shechter et al. | 434/19 |
| 2004/0005531 | A1 * | 1/2004 | Varshneya et al. | 434/11 |
| 2007/0009860 | A1 * | 1/2007 | Young | 434/21 |
| 2008/0003543 | A1 * | 1/2008 | Varshneya | 434/21 |

* cited by examiner

TWO BEAM SMALL ARMS TRANSMITTER

BACKGROUND OF THE INVENTION

The Multiple Integrated Laser Engagement System (MILES 2000®) produced by Cubic Defense Systems, Inc., exemplifies a modern realistic force-on-force training system. As a standard for direct-fire tactical engagement simulation, MILES 2000 is a system employed for training soldiers by the U.S. Army, Marine Corps and Air Force, NATO forces, and other international forces such as the Royal Netherlands Marine Corps, Kuwait Land Forces and the UK Ministry of Defence.

MILES 2000 components include wearable systems for individual soldiers and marines as well as interface devices for combat vehicles (including pyrotechnic devices), personnel carriers, antitank weapons, and pop-up and stand-alone targets. The MILES 2000 laser-based system allows troops to fire infrared "bullets" from the same weapons and vehicles that they would use in actual combat. These simulated direct-fire events produce realistic audio/visual effects and casualties, identified as a "hit," "miss," or "kill." The events are then recorded, replayed and analyzed in detail during After Action Reviews, which give commanders and participants an opportunity to review their performance during the training exercise. Unique player ID codes and Global Positioning System (GPS) technology ensure accurate data collection, including casualty assessments and participant positioning.

The MILES 2000 individual weapons system includes small, lightweight components mounted on either a vest or H-harness; and a Small Arms Transmitter (SAT) mounted on the soldier's individual weapon or machine gun, which may be appreciated with reference to the commonly-assigned U.S. Pat. No. 5,475,385 issued to Parikh et al. and incorporated herein by reference. Realism is enhanced by employing light wearable equipment that is nearly transparent to the user, particularly the H-harness or vest that may be worn over other combat equipment. The system replicates the ranges and lethality of the soldier's individual weapon or machine gun while holding shooter alignment during blank fire; thereby training the shooter under conditions substantially identical to actual combat weapons operation. Thus, among other demanding technical requirements, MILES 2000 requires the SAT laser beam axis to be properly aligned with the line of sight (LOS) axis of the weapon to ensure its range effectiveness.

In present SAT, the laser beam optical axis is aligned with the LOS axis of the weapon using an alignment instrument referred to as an Automatic Small Arms Alignment Fixture (ASAAF). This instrument has been recognized to have numerous problems including poor reliability, lack of ease of portability for field alignments, and relatively large expense.

Use of the ASAAF for SAT alignment does not teach the user the true doctrine of weapon alignment, because the SAT is aligned by an operator of the ASAAF and not by the personnel associated with the weapon. The weapon user must learn the weapon sight alignment task and get trained or otherwise experienced before he can feel comfortable and confident in the end alignment result. The weapons user needs to have positive training in the alignment of the weapon sights.

BRIEF SUMMARY OF THE INVENTION

A Small Arms Transmitter (SAT) having two optical sources for use in a military training environment is described. The SAT includes an infrared laser as a first optical source. The infrared laser is mounted within a housing configured for mounting on small arms, such as a barrel of a weapon. A visible optical source, such as a visible wavelength laser, is configured as a second optical source. The visible wavelength laser is mounted in the housing and configured to have an optical axis substantially coincident with the optical axis of the infrared laser. The visible wavelength laser can be configured to be selectively energized during a beam alignment operation. A half silvered mirror, hot mirror, cold mirror, dichroic, and the like, can be configured to combine the beam from the infrared laser with the beam from the visible wavelength laser to produce a combined beam.

The optical axis of the combined infrared and visible wavelength lasers can be adjusted using a pair of optical steering modules. A first optical steering module can be configured to steer the combined beam in a first axis that can substantially correspond to an azimuth axis, while a second optical steering module can be configured to steer the combined beam along a second axis substantially orthogonal to the first axis, which can correspond to an elevation axis. Each of the optical steering modules can be optical, electrical, or electro-optical modules configured to steer the combined beam. For example, an optical steering module can include a pair of counter-rotating optical wedges.

Embodiments of the invention include a SAT configured to be weapon mounted for use in a combat force training system. The SAT includes a first optical source having a first beam at a non-visible wavelength configured to provide signaling in the combat force training system, a second optical source having a second beam in a visible wavelength, and an optical combiner configured to combine the first beam with the second beam to generate a combined beam having a substantially common optical axis.

Another embodiment of the invention includes a SAT configured to be weapon mounted for use in a combat force training system. The SAT includes an Infrared (IR) laser having an IR output beam and configured to provide signaling in the combat force training system, a visible wavelength laser having a visible wavelength output beam, an optical combiner configured to combine the IR output beam with the visible wavelength output beam to generate a combined beam having a substantially common optical axis, a beam alignment module configured to steer the combined beam, and a controller configured to selectively enable the visible wavelength laser.

Embodiments of the invention include a method of aligning a weapon mounted SAT configured for use in a combat force training system. The method includes activating a visible light source in the SAT, aiming the visible light source at a target positioned a predetermined distance from the weapon, aligning the visible light source substantially along a first axis, and aligning the visible light source substantially along a second axis such that the visible beam illuminates the target when the target is viewed through mechanical sights positioned on the weapon, wherein the second axis is substantially perpendicular to the first axis.

Another embodiment of the invention includes a method of aligning a weapon mounted SAT configured for use in a combat force training system. The method includes receiving an alignment activation command, energizing a visible light source in response to the alignment activation command, receiving a first axis alignment input, and receiving a second axis alignment input, wherein the second axis is substantially perpendicular to the first axis.

BRIEF DESCRIPTION OF THE DRAWINGS

The features, objects, and advantages of embodiments of the disclosure will become more apparent from the detailed description set forth below when taken in conjunction with the drawings, in which like elements bear like reference numerals.

DETAILED DESCRIPTION OF THE INVENTION

Figure 1:
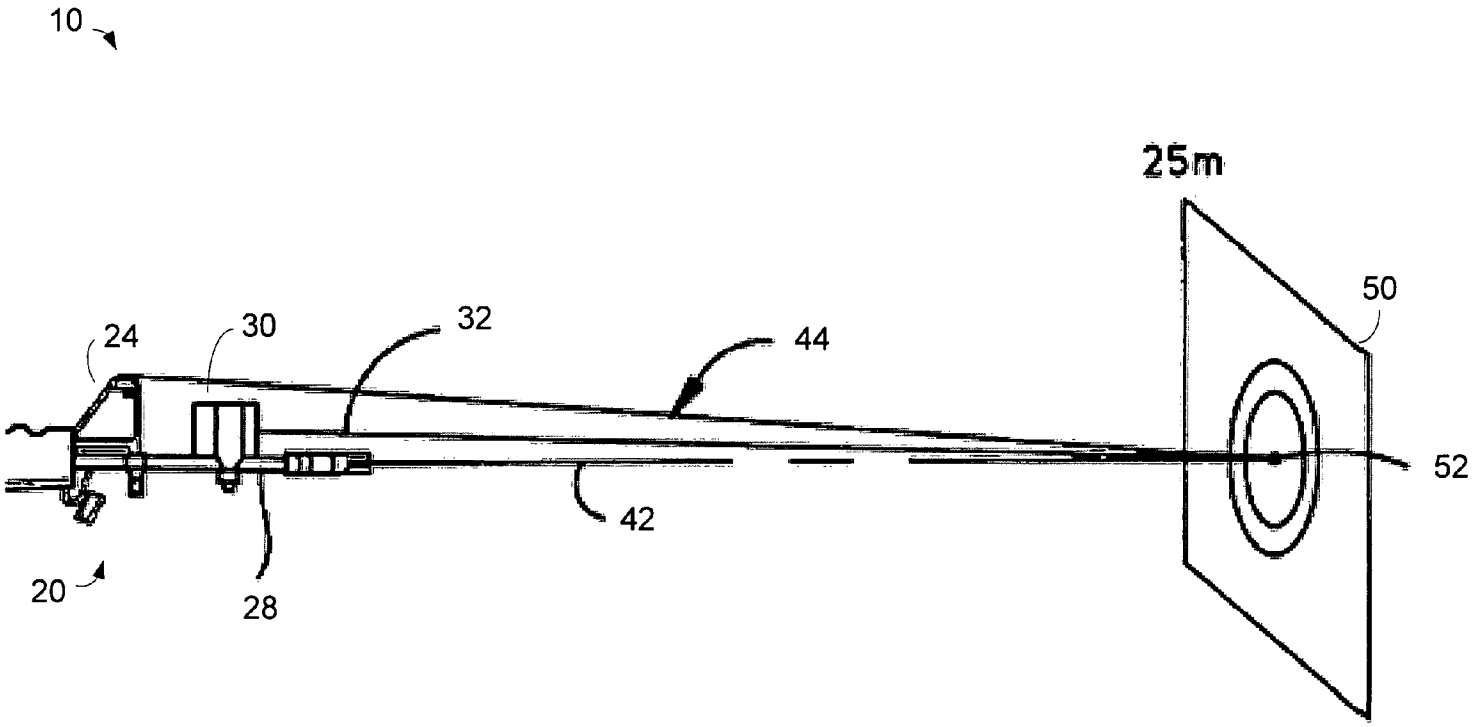
FIG. 1 is a functional block diagram of a SAT mounted on a barrel of a weapon.

A multiple beam SAT having at least one visible beam substantially aligned with an optical axis of a laser of the SAT is described herein. The SAT can also include a beam steering module that can be adjusted by the user of a weapon on which the SAT is mounted. The inclusion of a visible beam aligned with the optical axis of the laser allows the user to have visual feedback when aligning the optical beam with the sights on the weapon.

The multiple beam SAT can include an infrared (IR) laser that is configured to operate in accordance with the MILES requirements. A second optical source can be a visible wavelength laser. An optical combiner, such as a half silvered mirror, hot mirror, cold mirror, dichroic, and the like, can be used to combine the beam of the IR laser with the beam from the visible wavelength laser to generate a combined optical beam having substantially a single optical axis.

The combined optical beam can be steered using an optical steering module. The optical steering module can steer the combined optical beam optically, electrically, or electro-optically. The optical steering module can be configured using two independent optical steering modules in order to allow the user to steer the combined optical beam along two substantially perpendicular axis. A first axis can substantially correspond to an azimuth axis and a second axis can substantially correspond to an elevation axis. Allowing independent adjustments along the two substantially perpendicular axes allows for ease of alignment of the combined optical beam.

The visible wavelength laser need not be energized each time that the IR laser is energized. For example, it may be advantageous for military training purposes to ensure the visible wavelength laser is de-energized or otherwise suppressed during training exercises. The visible wavelength laser can be selectively energized during a calibration or alignment exercise where the weapons users align the optical beams with the mechanical sights on the weapon.

The SAT can include a controller that can selectively energize the visible wavelength laser. The controller can include, for example, a receiver that is configured to receive a signal from an alignment module that indicates when the visible wavelength laser is to be energized. The receiver can be configured, for example, to receive an electrical signal or an optical signal. The receiver can be configured to receive an electrical signal such as a signal conveyed through a wired input. Alternatively, the receiver can be configured to receive a wireless signal, such as over a RF link.

The alignment module can be a simplified version of the ASAAF. The alignment module can include a driver that is configured to provide the control signal that informs the SAT to energize the visible wavelength laser. The driver can be configured to output a n electrical signal, and optical signal, or some combination of electrical and optical signals. In one embodiment, the driver can be configured to provide an RF signal that can be used to simultaneously command a plurality of SAT devices to energize their respective visible wavelength laser. In such a manner, the alignment module can be used during the simultaneous calibration or alignment of multiple SAT devices.

FIG. 1 is a functional block diagram of an embodiment of an alignment system 10 for a SAT 30 mounted on a barrel 28 of a weapon 20. Only a portion of the weapon 20 is shown for the sake of clarity.

The alignment system 10 is configured for a weapon 20, such as a rifle, machine gun, and the like, having a barrel 28 from which projectiles can be fired. The weapon 20 can include one or more sights 24, typically referred to as iron sights, that are used to align an aimpoint of the weapon 20.

To align the aimpoint of the weapon 20, the weapon 20 can be aimed at a target 50 a predetermined distance from the weapon 20. The user of the weapon 20 can align the iron sights 24 such that a line of sight 44 through the sights 24 substantially aligns with a projectile path 42 fired from the weapon 20 at the predetermined distance. The predetermined distance can be any distance that may be representative of the distances encountered during combat. For example, the predetermined distance to the target 50 can be approximately 25 meters, approximately 300 meters, or some other distance. The iron sights 24 of the weapon 20 can be considered to be aligned when a predetermined percentage of fired projectiles strikes the target 50 within predetermined alignment area. The percentage may vary depending on the distance to the target, and can be, for example 70-80% of the projectiles at a range of 25 meters.

A SAT 30 can be mounted on the barrel 28 of the weapon 20. The SAT 30 can be aligned such that an optical axis 22 of a laser beam projected from the SAT 30 aligns with a center 52 of the target 50 when the target 50 is placed at the desired alignment distance.

In one embodiment, the SAT 30 can be aligned during an alignment procedure. During the alignment procedure, the SAT 30 can be configured to emit a visible beam along the optical axis 32. The user can aim the weapon 20 such that the sights are aimed at a target 50 placed a predetermined distance from the weapon 20. The target 50 can be configured to have a reflective portion at substantially the center 52 of the target 50. In one embodiment, the target 50 can be configured as a reflector having a cross hair that produces an intense reflection when the visible beam from the SAT 30 illuminates it. The user can align the output of the SAT 30 to align the optical axis 32 of the visible beam with the line of sight 44 and projectile path 42. The user of the weapon 20 is thus provided additional positive training in the aspects of weapon 20 aimpoint alignment.

In one embodiment, the SAT 30 is normally configured to output a non-visible wavelength when activated. The SAT 30 can be selectively commanded to emit a visible wavelength beam during the alignment procedure. The SAT 30 can be configured with a controller (not shown) that reacts to a command provided by an alignment module (not shown) that can be similar to an Automated Small Arms Alignment Fixture (ASAAF). However, as will be described in further detail below, the alignment module need not be restricted to commanding a single SAT 30, but may be configured to simultaneously communicate to a plurality of SATs 30.

Figure 2:
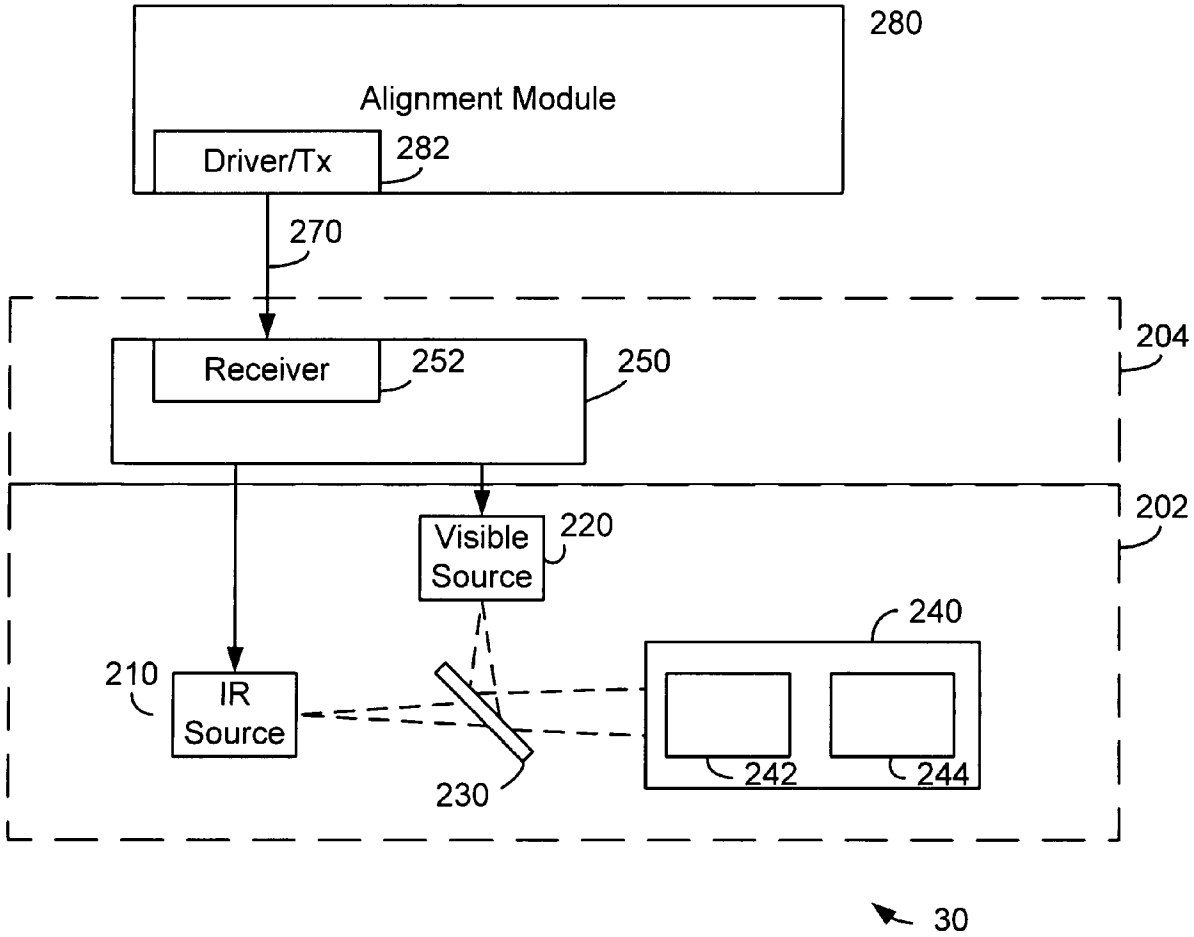
FIG. 2 is a functional block diagram of an embodiment of a two beam SAT in conjunction with an alignment module.

FIG. 2 is a functional block diagram of an embodiment of a SAT 30 in conjunction with an alignment calibration module 280. The SAT 30 may only communicate with the alignment calibration module 280 during an alignment procedure. The alignment module 280 can be configured to command the SAT 30 to an alignment mode. The SAT 30 may not, and typically does not, need to communicate with the alignment calibration module 280 during combat training exercises.

The embodiment of the SAT 30 can include an optical assembly 202 coupled to an electrical assembly 204. The optical assembly 202 can include the housing and mounts required to stabilize the various optical components. The optical assembly 20 can include, for example, a housing that is integrated with a weapon mount.

The optical assembly 202 can include a first optical source 210 configured to provide a first optical output. The first optical source 210 can be, for example, and IR laser configured to operate according to the requirements of the MILES specification. The first optical source 210 can be, for example, an IR laser having an optical wavelength that is approximately 904 nm. The optical axis of the first optical source 210 can be approximately aligned with the optical axis of the SAT 30.

A second optical source 220 can be configured as a visible wavelength optical source that can be selectively activated. The second optical source 220 can be selectively activated either by selectively providing an output optical beam, or by selectively occluding an optical beam from the second optical source 220. In one embodiment, the second optical source 220 can be selectively energized, and may be de-energized when not in use. De-energizing the second optical source 220 when not needed can be advantageous where power consumption of the SAT 30 is an issue.

The second optical source 220 can be configured as a visible wavelength laser that is configured to output a beam in the visible spectrum when energized. For example, the second optical source 220 can be configured to output a beam of approximately 635 nm when energized.

The optical outputs from the first optical source 210 and the second optical source 220 can be combined to substantially the same optical axis. In one embodiment, the first optical source 210 is aligned with an optical axis that is substantially the optical axis of the SAT 30. The second optical source 20 is aligned with an optical axis that is substantially at 90 degrees relative to the optical axis of the first optical source 210. A mirror 230 placed at approximately 45 degrees relative to the optical axis can be used to substantially align the optical axes of the two optical sources 210 and 220 into a single optical axis. The mirror 20 can be, for example, a half silvered mirror that allows the optical output from the first optical source 210 to substantially pass through it. The mirror 230 can be configured to substantially reflect the optical output from the second optical source 220, such that the optical beams from the two optical sources 210 and 220 are substantially aligned to a common optical axis. In another embodiment, the mirror 230 can be a dichroic. In another embodiment, the mirror 230 can be a cold mirror. In yet another embodiment, where the positions of the first optical source 210 is swapped with the position of the second optical source 220, the mirror 230 can be a hot mirror. In still another embodiment, the mirror 230 can be some other optical combiner used to combine the two beams to substantially a single optical axis.

The combined optical beams can be coupled to a beam alignment module 240. The beam alignment module 240 can be configured to steer the combined optical beams. A user of a weapon on which the SAT 30 is mounted can align the optical beams from the SAT 30. Therefore, the beam alignment module 240 can be configured for ease of use.

In one embodiment, the beam alignment module 240 can be configured to have two separate beam steering modules 242 and 244. A first beam steering module 242 can be configured to steer the combined optical beams substantially along a first axis. The first axis can be, for example, a horizontal or azimuth axis. The second beam steering module 244 can be configured to steer the combined optical beams substantially along a second axis that is substantially perpendicular to the first axis. For example, the second axis can be a vertical or elevation axis. The first and second beam steering modules 242 and 244 can be configured in series, such that the steered optical beam from one beam steering module, for example 242, is passed through the other beam steering module, in this example 244. Of course, the beam steering modules 242 and 244 need not be configured to steer the combined optical beams along perpendicular axis, and need not even steer the beams along a linear axis. Furthermore, the order for steering the combined beam is not a limitation. The combined beam can be steered first along an elevation axis and then along an azimuth axis.

The beam alignment module 240, and each of the beam steering modules 242 and 244 can be configured as an optical device, and electrical device, or an electro-optical device. For example, each beam steering module 242 and 244 can be configured as a pair of counter-rotating optical wedges, which may be referred to as Risley wedges. The counter-rotating wedges can be aligned such that the combined optical beam passing through it can be steered along a substantially linear axis. In another embodiment, a beam steering module, for example 242, can be configured as a plano-concave lens in combination with a plano-convex lens.

In another embodiment, each beam steering module 242 and 244 can be configured as a reflective active optical element, an acousto-optic modulator or a spatial light modulator (SLM). Electro-optical configurations may be advantageous because they can be implemented as solid state devices. The electro-optical devices can thus eliminate the need for moving parts or other mechanical parts, such as the mechanical parts needed to implement counter rotating wedges. For example, an acousto-optic modulator can be configured as a modulator produced by IntraAction Corporation having part number DTD-274HD6M. An example of a spatial light modulator is the XY series of spatial light modulators available from Boulder Nonlinear Systems, Inc.

Of course, the beam alignment module 240 is not limited to two beam steering modules 242 and 244, but may have one or more beam steerers. For example, a single pair of counter-rotating optical wedges can be used to align a combined beam. The wedges can be rotated relative to one another to displace the optical beam substantially along an axis, and the entire optical wedge pair can be rotated to rotate the axis on which the optical beam is displaced. Other beam steering modules can be similarly configured to steer the combined optical beam.

It should be noted that the beams from the first optical source 210 and the second optical source 220 are typically at different wavelengths. The difference in the wavelengths from the two optical sources 210 and 220 may create different beam divergence from each beam steering module 242 and 244. For example, a pair of counter rotating optical wedges will displace the beam from an IR laser at approximately 904 nm by an angular offset that is different from an angular offset for a visible wavelength laser operating at approximately 635 nm. The angular offset error introduced by the beam steering modules 242 and 244 can be negligible relative to a beam divergence. For example, if each beam steering module 242 and 244 configured as a pair of optical wedges is configured to produce a total beam deflection of no greater than 3 degrees, the worst case angular offset error between an IR laser beam and a visible wavelength laser beam is approximately 0.4 mrad. This amount of angular error is relatively small compared to beam divergence at a distance of approximately 25 meters. Thus, it is unlikely that the angular offset error will affect the weapon effective range of performance during operation in combat exercises.

The SAT 30 electrical assembly 204 can include a controller 250 having a receiver 250. The receiver 250 can be configured to receive a command from an alignment calibration module 280 instructing the SAT 30 to energize the second, or visible wavelength optical source.

The receiver 252 can be configured to receive a wired signal or a wireless signal. Where the receiver 252 is configured to receive a wired signal, the receiver 252 can be configured to have an interconnect that couples to a mating connector from a cable or connector coupled to the alignment calibration module 280. In the embodiment where the receiver 252 is configured to receive a wireless signal, the receiver 252 can be configured to receive an RF signal or an optical signal transmitted by the alignment calibration module 280.

The receiver 252 can direct received messages to the controller 250. The controller 250 can determine whether the received commands instruct the controller to selectively activate the second optical source 220. Additionally, where the beam alignment module 240 is implemented at least partially as an electro-optical device, the controller 250 can be configured to provide alignment instructions to the beam alignment module 240.

The alignment calibration module 280 can be configured as a simplified version of an ASAAF. The alignment calibration module 280 can include a driver 282 that is configured to provide the one or more commands to the SAT 30. For example, the driver 282 can be configured as a wireless transmitter configured to communicate to the SAT 30 over a wireless link. The driver 282 can be, for example, an RF transmitter or an optical transmitter. By implementing a wireless link, the alignment calibration module 280 can have the ability to simultaneously communicate commands to a plurality of SATs. For example, the alignment calibration module 280 can simultaneously issue a command to energize the visible wavelength optical sources for all SATs within a predetermined range.

Figure 3:
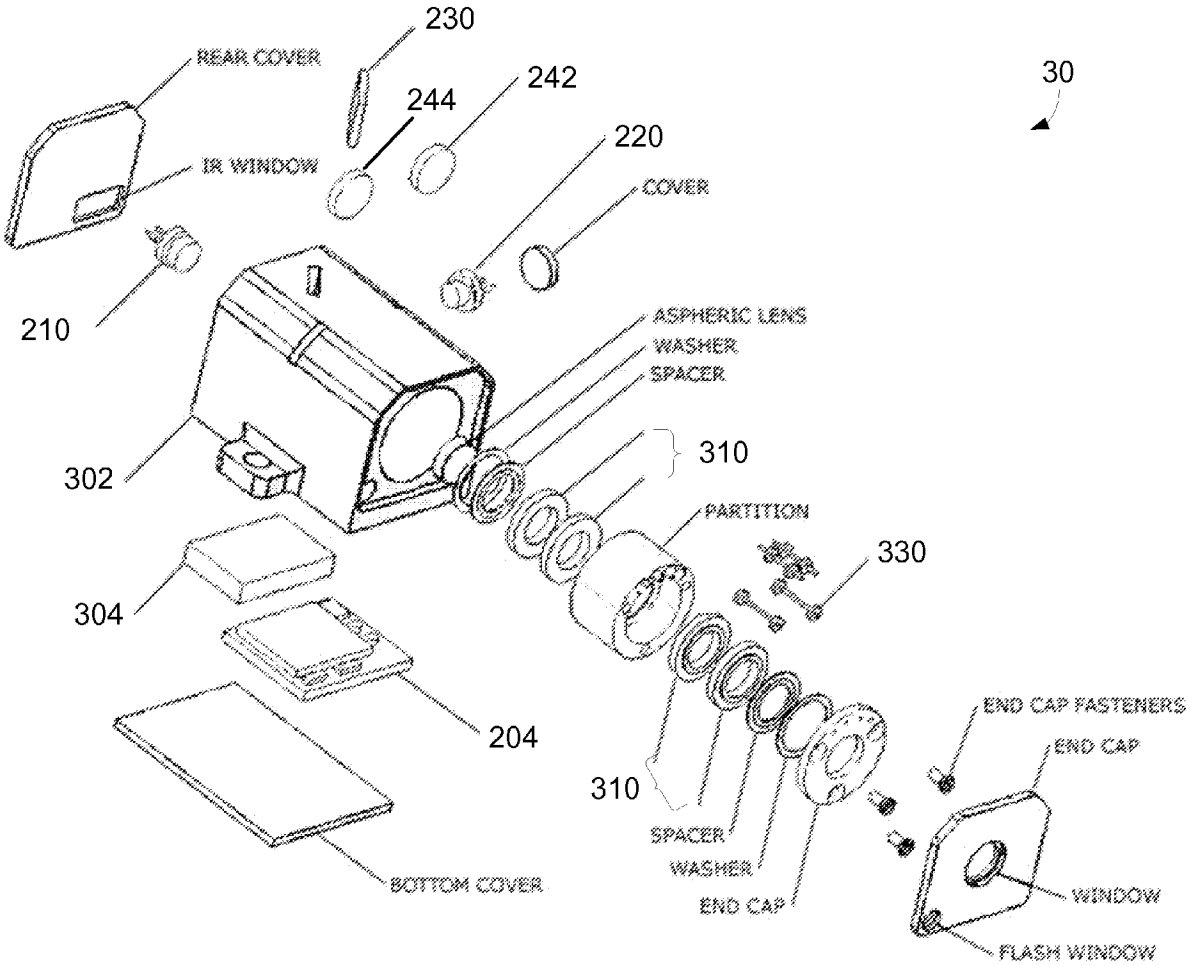
FIG. 3 is an exploded view of an embodiment of a two beam SAT.

FIG. 3 is an exploded view of an embodiment of a SAT 30, such as the SAT shown in the system of FIG. 1. The SAT 30 includes an IR laser configured as the first optical source 210. The IR laser is positioned with an optical axis generally along a projectile path. The IR laser can be mounted in a housing 302 that can be manufactured, for example, of a rigid material, such as aluminum, steel, ceramic, and the like, or some other rigid material. A second optical source 220 can be a visible wavelength laser such as a red laser. The second optical source 220 can be mounted in the housing 320 with an optical axis substantially at 90 degrees relative to the optical axis of the first optical source 210. A mirror 230, such as a cold mirror, can be positioned in a recess or slot in the housing 302. The mirror 230 can be angled at substantially 45 degrees relative to the optical axes of the first optical source 210 and the second optical source 220.

The cold mirror 230 can operate to substantially pass the wavelength of the first optical source 210 and reflect the wavelength of the second optical source 220. Thus, the cold mirror 230 operates as a combiner for combining the optical beam from the first optical source 210 with the optical beam from the second optical source 220. The combined optical beams have substantially the same optical axis.

The combined optical beam is directed through a beam alignment module having a first beam steering module and second beam steering module. In the embodiment of FIG. 3, the first beam steering module includes a first pair of counter rotating optical wedges 310. A set of spur gears 330 can be configured to counter rotate the first pair of optical wedges 310. The first pair of optical wedges 310 can be aligned to deflect the combined beam substantially along a first axis.

The deflected optical beam from the first pair of optical wedges 310 can be directed to pass through a second pair of optical wedges 320. A second set of spur gears 330 can be configured to counter rotate the second pair of optical wedges 320. The second pair of optical wedges 320 can be aligned to deflect the combined beam substantially along a second axis that is substantially perpendicular to the first axis.

The housing 302 can be configured to accept the electrical assembly 204 and may also house a battery 304 that allows for portable operation of the SAT 30 for extended periods of time. The housing 302 can have one or more access points or access covers that are positioned to allow a user to align the combined beam by rotating the spur gears 330. For example, a user may initially align the first pair of optical wedges 310 by turning the spur gears 330 associated with the first pair of optical wedges 310 to deflect the optical beam along a first axis. The user may then align the second pair of optical wedges 320 by turning the spur gears 330 associated with the second pair of optical wedges 320 to deflect the optical beam along the second axis. The user may, for example, insert a tool through one or more access holes in the housing 302 to access the spur gears 330.

Figure 4:
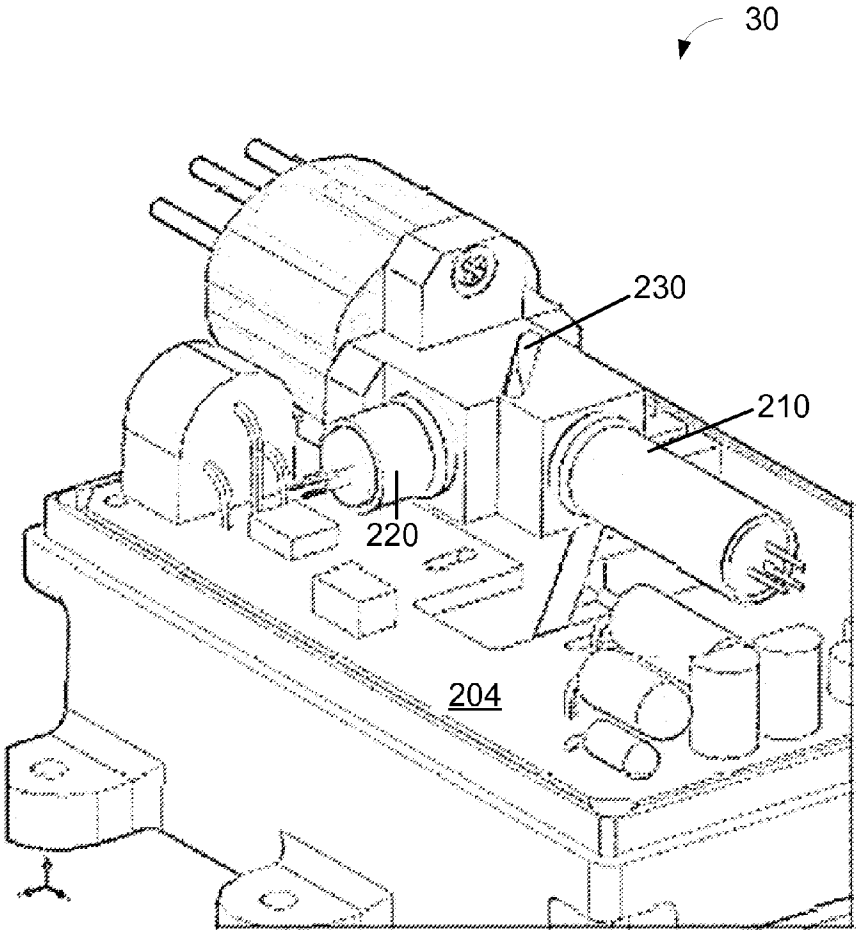
FIG. 4 is a partial view of an electrical assembly of an embodiment of a two beam SAT.

FIG. 4 is a partial view of an embodiment of a SAT 30 illustrating an arrangement of first and second optical sources 210 and 220, respectively. A first optical source 210, such as an IR laser, can be mounted at a rear of the SAT 30 and have a beam that projects substantially through the front of the SAT 30. A second optical source 220, such as a red laser, can be mounted to project a beam at substantially 90 degrees relative to the beam from the first optical source 210. A combiner or mirror, such as a cold mirror 230 can be positioned at approximately 45 degrees relative to the beams from the two optical sources 210 and 220, and can operate to combine the beams into substantially a single combined optical beam.

Figure 5:
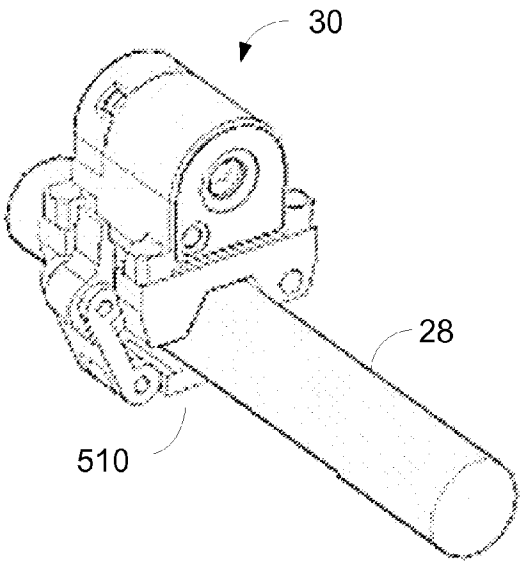
FIG. 5 is a perspective view of an embodiment of a SAT mounted on a barrel.

FIG. 5 is a perspective view of an embodiment of a SAT 30 mounted on a barrel 28, such as a barrel of a machine gun or rifle. The SAT 30 includes a releasable weapon mount 510 configured to releasably or otherwise removably attach the SAT 30 to the barrel 28 of the weapon. The releasable weapon mount 510 can be configured to mechanically clamp the SAT 30 to the barrel 28 with sufficient force to maintain a position of the SAT 30 during combat training missions.

Figure 6:
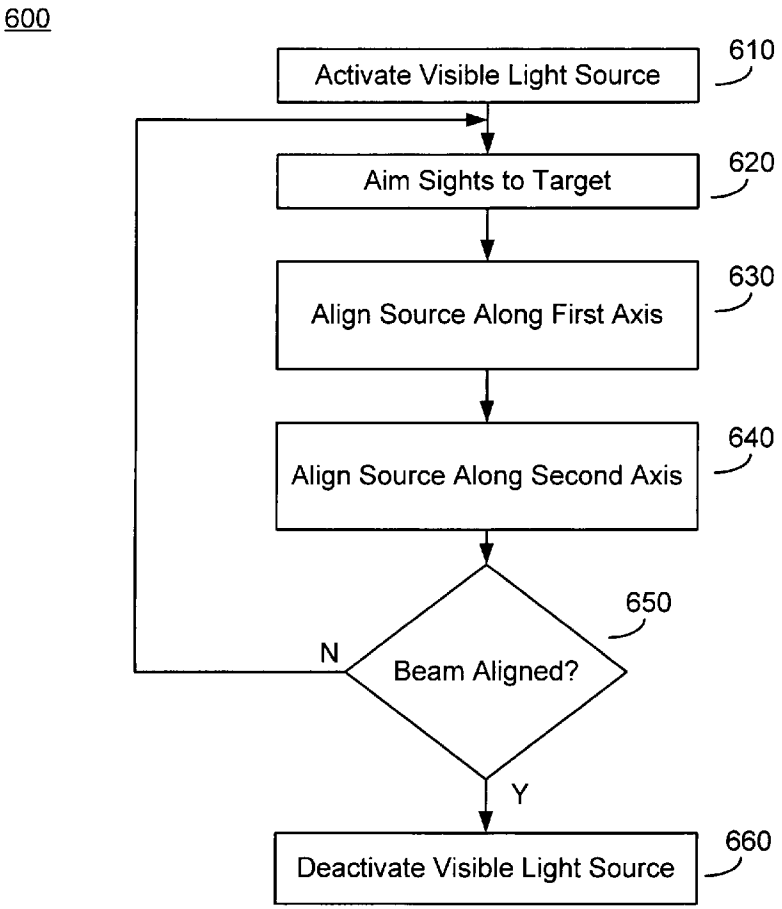
FIG. 6 is a flowchart of an embodiment of a method of aligning a two beam SAT.

FIG. 6 is a flowchart of an embodiment of a method 600 of aligning a two beam SAT. A user of a weapon can perform the method 600, for example, when aligning the SAT with the iron sights of a weapon. Alternatively, when alignment is performed automatically, the alignment module can perform the method 600.

The method 600 begins at block 610 when the user activates the visible wavelength optical source within the SAT. As described earlier, the visible wavelength optical source can be selectively enabled, and is typically only enabled during the SAT alignment procedure. The user can, for example, broadcast or otherwise communicate a visible output enable signal to the SAT using an alignment module.

Once the visible wavelength optical source is energized, the user proceeds to block 620 and aims the weapon at a target at a predetermined distance. The user can aim the weapon, for example, by aligning a line of sight through one or more iron sights on the weapon with the target. As described earlier, the target can be a reflective target placed a predetermined distance from the user, such as approximately 25 meters away from the user.

After aiming the weapon at the target, the user proceeds to block 630 and aligns the visible beam substantially along a first axis. For the sake of description, the first axis will be described as a horizontal or azimuth axis. The user can align the visible beam substantially along the first axis by steering the beam substantially along the first axis. The user can steer the beam along the first axis by manipulating or otherwise controlling a beam steering module within the SAT. In one embodiment, the user can use a tool to rotate a first pair of counter rotating optical wedges in the SAT. In another embodiment, the user may reposition an angle of a plano-convex lens relative to a plano-concave lens. In another embodiment, the user can control a signal to a spatial light modulator.

After aligning the beam along the first axis, the user can proceed to block 640 and align the visible beam substantially along a second axis. The second axis can be advantageously substantially perpendicular to the first axis. For example, the second axis can be a vertical axis or elevation axis. The user can deflect the beam substantially along the second axis in much the same manner available for deflecting the beam along the first axis. The user can deflect the visible beam using optical, electrical, or electro-optical beam steering. The manner of deflecting the beam along the second axis need not be the same as the manner used to deflect the beam along the first axis.

Once the user has aligned the visible beam along the second axis, the user proceeds to decision block 650 to determine if the visible beam is aligned with the iron sights of the weapon. If not, the user returns to block 620 to repeat the aim and alignment steps until suitable alignment is achieved. If at block 650, the user determines that the visible beam is aligned, the user proceeds to block 660 and de-energizes or otherwise disables the visible beam.

Figure 7:
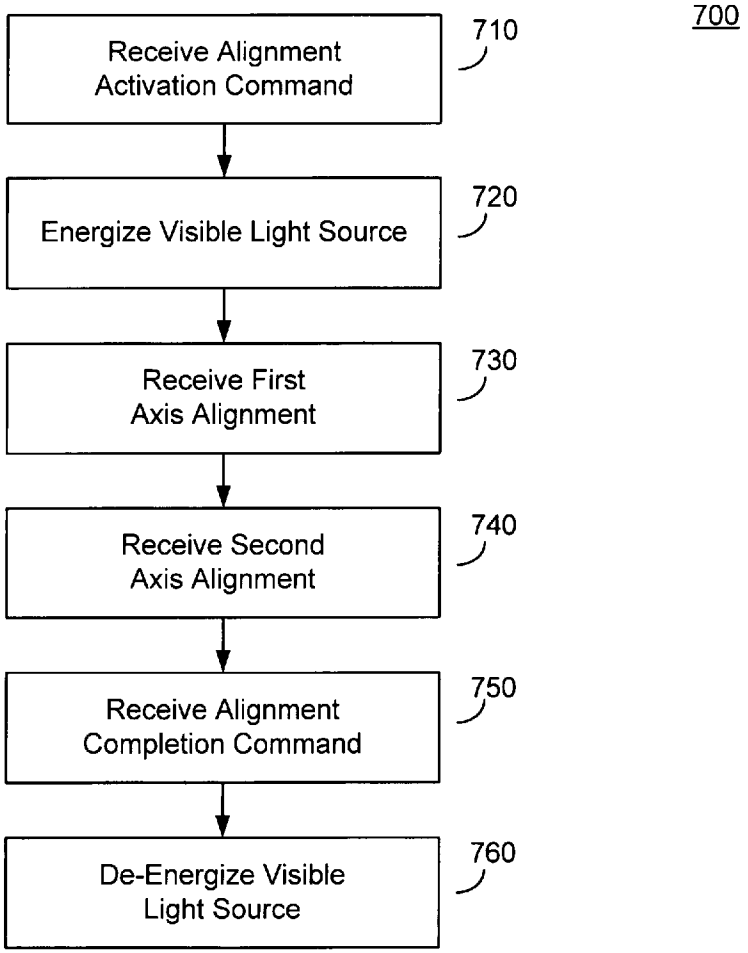
FIG. 7 is a flowchart of an embodiment of aligning a two beam SAT.

FIG. 7 is a flowchart of an embodiment of a method 700 of aligning a two beam SAT. The method 700 can be performed, for example, by the two beam SAT shown in FIG. 2. The method 700 begins at block 710 where the SAT receives an alignment activation command. As described earlier, an alignment module may transmit the alignment activation command, and the SAT may receive the command across a wired link or a wireless link. Additionally, the alignment activation command may be a command that is dedicated to the particular receiving SAT or may be a broadcast message that can be received and acted upon by a plurality of SAT devices having the described capabilities.

After receiving the alignment activation command, the SAT proceeds to block 720 and energizes the visible light source. In one embodiment, the visible light source can be a laser light source having a beam in a visible wavelength. The visible light source can be positioned or otherwise aligned to have an optical axis that is substantially the same as the optical axis of an IR laser used in the SAT. In one embodiment, the IR laser may also be energized during the time that the visible beam laser is energized, but activation of any non-visible light sources is not a requirement.

After energizing the visible light source, the SAT proceeds to block 730. At block 730, the user of the SAT aims the weapon on which the SAT is mounted such that the mechanical sights, such as the iron sights, of the weapon are aligned with a target. That is, the user of the weapon can manually align a line of sight with a target. The SAT can then receive a first axis alignment.

In one embodiment, the SAT can receive a mechanical alignment input by the user of the weapon. The mechanical alignment can be, for example, the rotation of a spur gear that is configured to rotate a first pair of counter rotating optical wedges. In one embodiment, the first axis can be substantially along a horizontal or azimuth axis. In another embodiment, the first axis can be substantially along a vertical or elevation axis. The method 700 does not require a particular axis be aligned first, and the initial axis of alignment need not even be along the vertical or horizontal directions.

In another embodiment, the SAT can be configured to receive an electrical alignment signal from, for example, the alignment module. The electrical alignment module can, for example, adjust a beam steerer located within the SAT.

After receiving the first axis alignment, the SAT proceeds to block 740 and receives the second axis alignment. In one embodiment, the second axis is substantially perpendicular to the first axis. Having the first and second axis substantially perpendicular allows for ease of alignment when alignment is performed manually. In such an embodiment, alignment of the SAT provides positive training for the user of the weapon in the task of weapon alignment. As was the case with alignment along the first axis, the SAT can be configured to receive a mechanical, electrical, or electromechanical input to align the SAT along the second axis.

After receiving alignment along the second axis, the SAT proceeds to block 750 and receives an alignment completion command. The alignment module can be configured to issue the alignment completion command at the cessation of a SAT alignment exercise. Alternatively, the SAT may receive the alignment completion command by determining a loss of the alignment activation command. That is, the alignment completion command may be the termination of broadcast of the alignment activation command.

After receiving the alignment completion command, the SAT proceeds to block 760 and de-energizes the visible light source. The visible light source can be de-energized to conserve power when the SAT is battery powered. Additionally, the visible light source can be de-energized in order to provide a more realistic weapon simulation, where the weapon normally does not have a visible light source for targeting.

Apparatus and methods have been described for a SAT having user alignment capabilities. The SAT can be implemented as a two-beam SAT. A first laser can generate the first optical beam, and the first optical beam can correspond to an IR laser beam that can be modulated in accordance with the MILES 2000 requirements. A second laser having a visible wavelength output can be used as the source of the second beam. The second laser having visible output beam can be selectively energized, such that the visible beam can be energized during a SAT alignment exercise. The second beam can be combined with the first beam along substantially a single optical axis.

The combined optical beams can be configured to pass through a beam alignment module. The beam alignment module can include a first beam steerer configured to substantially steer the combined beam along a first axis. The second beam steerer can be configured in series with the first beam steerer and can be configured to substantially steer the combined beam along a second axis that can be substantially perpendicular to the first axis.

The steps of a method, process, or algorithm described in connection with the embodiments disclosed herein may be embodied directly in hardware, in a software module executed by a processor, or in a combination of the two. The various steps or acts in a method or process may be performed in the order shown, or may be performed in another order. Additionally, one or more process or method steps may be omitted or one or more process or method steps may be added to the methods and processes. An additional step, block, or action may be added in the beginning, end, or intervening existing elements of the methods and processes.

The above description of the disclosed embodiments is provided to enable any person of ordinary skill in the art to make or use the disclosure. Various modifications to these embodiments will be readily apparent to those of ordinary skill in the art, and the generic principles defined herein may be applied to other embodiments without departing from the spirit or scope of the disclosure. Thus, the disclosure is not intended to be limited to the embodiments shown herein but is to be accorded the widest scope consistent with the principles and novel features disclosed herein.

What is claimed is:

1. A Small Arms Transmitter (SAT) configured to be weapon mounted for use in a combat force training system, the SAT comprising:

a receiver configured to receive inputs from an alignment calibration module;

a first optical source providing a first beam at a non-visible wavelength configured to provide signaling in the combat force training system;

a second optical source providing a second beam in a visible wavelength; and an optical combiner configured to combine the first beam with the second beam by reflecting at least a portion of either or both of the first beam or the second beam to generate a combined beam having a common optical axis; and a beam alignment module communicatively coupled with the receiver and configured to steer the combined beam in response to alignment instructions received from the receiver.

2. The SAT of claim 1, wherein the beam alignment module comprises:

a first beam steering module configured to steer the combined beam along a first axis; and a second beam steering module configured to steer the combined beam along a second axis perpendicular the first axis.

3. The SAT of claim 1, wherein the beam alignment module comprises at least one of an optical beam steering module or an electro-optical beam steering module.

4. The SAT of claim 1, wherein the beam alignment module comprises a pair of counter rotating optical wedges positioned in series with the combined beam.

5. The SAT of claim 1, wherein the beam alignment module comprises a spatial light modulator.

6. The SAT of claim 1, wherein the first optical source comprises an InfraRed (IR) laser.

7. The SAT of claim 1, wherein the second optical source comprises a laser having a visible wavelength output.

8. The SAT of claim 1, wherein the optical combiner comprises a dichroic.

9. The SAT of claim 1, wherein the optical combiner comprises a cold mirror.

10. The SAT of claim 1, further comprising a controller configured to selectively enable the second optical source in response to an alignment activation command, wherein the alignment activation command is communicated simultaneously to a plurality of SATs.

11. The SAT of claim 1, further comprising a housing configured to house the first optical source, the second optical source, and the optical combiner, and comprising a mount configured to locate the SAT on a barrel of the weapon.

12. A Small Arms Transmitter (SAT) configured to be weapon mounted for use in a combat force training system, the SAT comprising:

a receiver configured to receive inputs from an alignment calibration module;

an Infrared (IR) laser having an IR output beam and configured to provide signaling in the combat force training system;

a visible wavelength laser having a visible wavelength output beam;

an optical combiner configured to combine the IR output beam with the visible wavelength output beam by reflecting at least a portion of either or both of the IR output beam or the visible wavelength output beam to generate a combined beam having a common optical axis;

a beam alignment module configured to steer the combined beam in response to alignment instructions received through the receiver; and a controller configured to selectively enable the visible wavelength laser.

13. The SAT of claim 12, wherein:

the IR laser is positioned with the IR output beam along a first axis;

the visible wavelength laser is positioned with the visible wavelength output beam along a second axis perpendicular to the first axis; and wherein the optical combiner comprises a mirror positioned at an intersection of the first axis with the second axis.

14. The SAT of claim 12, wherein the optical combiner comprises at least one of a dichroic, a cold mirror, or a hot mirror.

15. The SAT of claim 12, wherein the beam alignment module comprises:

a first beam steering module configured to steer the combined beam along a first axis; and a second beam steering module configured to steer the combined beam along a second axis perpendicular the first axis.

16. A method of aligning a weapon mounted Small Arms Transmitter (SAT) configured for use in a combat force training system, the method comprising:

activating a visible light source in the SAT;

reflecting at least a portion of the a visible beam of the light source toward a target;

aiming the visible light source at the target positioned a predetermined distance from the weapon;

receiving an input signal from an alignment calibration module;

aligning in response to the input signal the visible light source along a first axis; and aligning in response to the input signal the visible light source along a second axis such that the visible beam illuminates the target when the target is viewed through mechanical sights positioned on the weapon, wherein the second axis is perpendicular to the first axis.

17. The method of claim 16, further comprising deactivating the visible light source.

18. The method of claim 16, wherein aligning the visible light source along the first axis comprises steering a combined optical beam comprising a beam from the visible light source combined with a beam from an IR light source.

19. The method of claim 16, wherein aligning the visible light source along the first axis comprises steering an optical beam from the visible light source that is coincident with an optical beam from an IR optical source.

20. The method of claim 16, wherein aligning the visible light source along the first axis comprises rotating a pair of counter-rotating optical wedges positioned in the path of an optical beam from the visible light source.

21. The method of claim 16, wherein aiming the visible light source at the target comprises aiming the visible light source at a reflective target.

22. A method of aligning a weapon mounted Small Arms Transmitter (SAT) configured for use in a combat force training system, the method comprising:

receiving an alignment activation command;

energizing a visible light source in response to the alignment activation command;

reflecting at least a portion of a beam of from the visible light source along an axis parallel to a direction in which the weapon is aimed;

receiving a first axis alignment input;

aligning the beam in response to the first axis alignment input;

receiving a second axis alignment input; and aligning the beam in response to the second axis alignment input, wherein the second axis is perpendicular to the first axis.

23. The method of claim 22, further comprising:

receiving an alignment completion command; and de-energizing the visible light source in response to the alignment completion command.

* * * * *